US008833638B2

(12) United States Patent
Pezzoli

(10) Patent No.: US 8,833,638 B2
(45) Date of Patent: Sep. 16, 2014

(54) DUAL DISPENSING CONTAINER

(75) Inventor: Paul Pezzoli, Portage, MI (US)

(73) Assignee: Kellogg Company, Battle Creek, MI (US)

( * ) Notice: Subject to any disclaimer, the term of this patent is extended or adjusted under 35 U.S.C. 154(b) by 82 days.

(21) Appl. No.: 13/155,758

(22) Filed: Jun. 8, 2011

(65) Prior Publication Data

US 2011/0233266 A1 Sep. 29, 2011

Related U.S. Application Data

(62) Division of application No. 11/863,574, filed on Sep. 28, 2007, now Pat. No. 7,988,034.

(60) Provisional application No. 60/848,751, filed on Oct. 2, 2006.

(51) Int. Cl.
*B65D 5/54* (2006.01)
*B65D 17/28* (2006.01)

(52) U.S. Cl.
CPC ..... *B65D 5/541* (2013.01); *B65D 5/542* (2013.01); *B65D 5/5445* (2013.01)
USPC ..... 229/235; 229/121; 229/237; 229/242

(58) Field of Classification Search
USPC ..... 229/121, 122, 120.011, 235, 237, 240, 229/242, 243, 244; 221/302, 305
See application file for complete search history.

(56) References Cited

U.S. PATENT DOCUMENTS

| | | | | |
|---|---|---|---|---|
| 2,118,380 | A | 5/1938 | Gresenz | |
| 2,269,039 | A | 1/1942 | Ross | |
| 2,754,047 | A | 7/1956 | Schmidt et al. | |
| 2,909,312 | A | 10/1959 | Conerty | |
| 3,002,613 | A | 10/1961 | Merkel et al. | |
| 3,168,234 | A | 2/1965 | Bartz | |
| 3,300,115 | A | 1/1967 | Schauer | |
| 3,583,597 | A | 6/1971 | Buttery et al. | |
| 3,761,012 | A | 9/1973 | Rosenburg, Jr. | |
| 3,765,044 | A | 10/1973 | Hanahan et al. | |
| 4,008,849 | A * | 2/1977 | Baber | 229/237 |
| 4,111,297 | A * | 9/1978 | Paulin | 229/237 |

(Continued)

FOREIGN PATENT DOCUMENTS

| | | | |
|---|---|---|---|
| GB | 2252548 | A | 2/1992 |
| GB | 2321238 | A | 7/1998 |
| WO | 0204302 | A1 | 1/2002 |

*Primary Examiner* — Gary Elkins
(74) *Attorney, Agent, or Firm* — Honigman Miller Schwartz and Cohn LLP; Kathryn D. Soulier; Jonathan P. O'Brien

(57) ABSTRACT

A container of the present invention is designed for shipping and holding various items. The container is formed from a blank of a material, such as corrugated material, plastic, paperboard, etc. and includes side panels extending between a top portion and a bottom portion. A tear line extends around the side panels for disengaging the top portion from the container thereby exposing all of the items extending along the side panels. An improved configuration of the perforations or slits along the tear line prevents the corners defined between the side panels from being damaged and deformed and provides for smooth tearing of the tear line from the container. A second tear section is defined in the a portion of the container by a perforation line with the tear section being separable from the top portion thereby partially exposing the items contained in the container.

9 Claims, 5 Drawing Sheets

(56) References Cited

U.S. PATENT DOCUMENTS

| | | | | | |
|---|---|---|---|---|---|
| 4,113,100 | A | * | 9/1978 | Soja et al. | 229/235 |
| 4,688,677 | A | * | 8/1987 | Roccaforte | 229/237 |
| 4,958,734 | A | | 9/1990 | Wood et al. | |
| 5,375,761 | A | | 12/1994 | Sullivan et al. | |
| 5,505,372 | A | | 4/1996 | Edson et al. | |
| 5,582,345 | A | * | 12/1996 | Lankhuijzen | 229/240 |
| 5,690,230 | A | | 11/1997 | Griffith | |
| 5,881,884 | A | | 3/1999 | Podosek | |
| 5,979,749 | A | | 11/1999 | Bozich | |
| 6,062,424 | A | | 5/2000 | Simile-Gravina et al. | |
| 6,073,833 | A | | 6/2000 | Desrosiers et al. | |
| 6,102,277 | A | | 8/2000 | Krapohl, Sr. | |
| D436,859 | S | | 1/2001 | Botsford et al. | |
| 6,435,351 | B1 | | 8/2002 | Gibb | |
| 6,536,624 | B2 | * | 3/2003 | Johnson et al. | 221/45 |
| 6,752,262 | B1 | | 6/2004 | Boriani et al. | |
| 6,766,941 | B1 | | 7/2004 | Tokarski | |
| 6,935,557 | B2 | | 8/2005 | Aubry et al. | |
| 6,974,033 | B2 | * | 12/2005 | McLeod et al. | 229/235 |
| 2003/0094461 | A1 | | 5/2003 | Knol | |
| 2006/0091192 | A1 | | 5/2006 | Coltri-Johnson | |
| 2006/0255105 | A1 | | 11/2006 | Sweet | |
| 2007/0295793 | A1 | | 12/2007 | Ho Fung et al. | |

* cited by examiner

DUAL DISPENSING CONTAINER

CROSS REFERENCE TO RELATED APPLICATION

The present application is a divisional of U.S. application Ser. No. 11/863,574 for A DUAL DISPENSING CONTAINER, filed Sep. 28, 2007 now U.S. Pat. No. 7,988,034, which claims the benefit of U.S. Provisional Patent Application Ser. No. 60/848,751 for A DUAL DISPENSING CONTAINER, filed on Oct. 2, 2006, both of which are hereby incorporated by reference in their entirety.

BACKGROUND OF THE INVENTION

1. Field of the Invention

The subject invention relates to containers, such as for example corrugated containers, paperboard containers, etc. having tear lines and blanks for making such containers. It should be understood by those of ordinary skill in the art that the word container is being used broadly to include, but not be limited to boxes, cartons, bags etc. and not limited in anyway to the material used.

2. Description of the Prior Art

Today, many types of containers have been developed for the attractive packaging of articles, such as food products, drug items, cosmetics, and the like. Conventionally, the containers are formed from a one-piece blank of material which is cut, scored and folded to produce a generally rectangularly shaped box.

The art is replete with various other designs of cartons, which are disclosed in U.S. Pat. No. D436,859 to Botsford et al.; U.S. Pat. No. 5,881,884 to Podosek; U.S. Pat. No. 5,979,749 to Bozich; U.S. Pat. No. 6,073,833 to Desrosiers et al.; U.S. Pat. No. 6,102,277 to Krapohl, Sr.; U.S. Pat. No. 6,435,351 to Gibb; U.S. Pat. No. 6,752,262 to Boriani et al.; U.S. Pat. No. 6,766,941 to Tokarski; and U.S. Pat. No. 6,935,557 to Aubry et al.

The U.S. Pat. No. 5,979,749 to Bozich, for example, teaches a carton that includes a front panel, a back panel, and side panels. The carton includes a top panel and a bottom panel. The carton includes a tear line extending about the periphery of the carton. The tear line extends into a gripper used by a consumer (not shown) to tear the tear line to expose the carton to an open top as a top cover is removed from the carton. A display section is defined in the front panel and can be separated from the front panel by a perforation or tear line. All items contained in the carton are exposed to and are accessible to the consumer when the top cover is removed from the carton. The items are only available for display purposes when the display section is severed from the front panel.

The U.S. Pat. No. 6,102,277 to Krapohl, Sr., for example, teaches a carton having a front panel, a back panel, and side panels. The carton includes a top panel and a bottom panel. The carton includes a tear line extending about periphery of the carton. The tear line extends into a gripper used by a consumer to tear the tear line to expose the carton to a first opening as the bottom of the carton is removed. The top panel is defined by a pair of flaps with each flap being integral with and extending from the front panel and the back panel, respectively. The flaps are mechanically interconnected with one another and present a second opening. The carton is designed for holding a bag containing perishable goods. One of the most common problems associated with the prior art patents is a configuration of the perforations or slits along the tear line, which results in the corners, defined between the front, back, and side panels, being damaged and deformed.

There is a constant need in the area of the packaging industry for an improved carton adaptable for dual dispensing of a product contained therein at a user's preference and an improved configuration of the perforations or slits along the tear line.

BRIEF SUMMARY OF INVENTION

The container of the present invention is designed for shipping and holding various items such as, food items, for example, candy bars, snacks, cereal boxes and the like or other products such as for example cosmetics, drugs, small shop items, such as screws, nuts, bolts, etc., detergent boxes etc. The container is formed from a blank of a material, such as paperboard, corrugated material, plastic etc., and includes a front panel, a back panel, and side panels extending between a top portion or panel and a bottom portion or panel. A peripheral tear line extends around the side panels for disengaging the top portion from the container thereby exposing all of the items extending along the front, back, and side panels. The tear line has an improved configuration of the perforations or slits interconnecting the tear line with the front, back, and side panels, which prevents the corners defined between the front, back, and side panels, from being damaged and deformed and provides for smooth tearing of the tear line from the carton. A second tear section is defined in the container by a non-linear perforation line with the tear section being removable to partially expose the items contained in the container and allow the contents to be removed one at a time.

An advantage of the present invention is to provide a container which can be used for dual dispensing of a product contained therein at a user's preference.

Another advantage of the present invention is to provide a container with improved perforation of a tear line which allows smooth tearing of the tear line from the carton without tearing corners defined between the panels.

Still another advantage of the present invention is to provide an improved configuration of the perforations or slits along the tear line, which prevents the corners defined between the front, back, and side panels, from being damaged and deformed and provides for smooth tearing of the tear line from the carton.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE INVENTION

Figure 1:
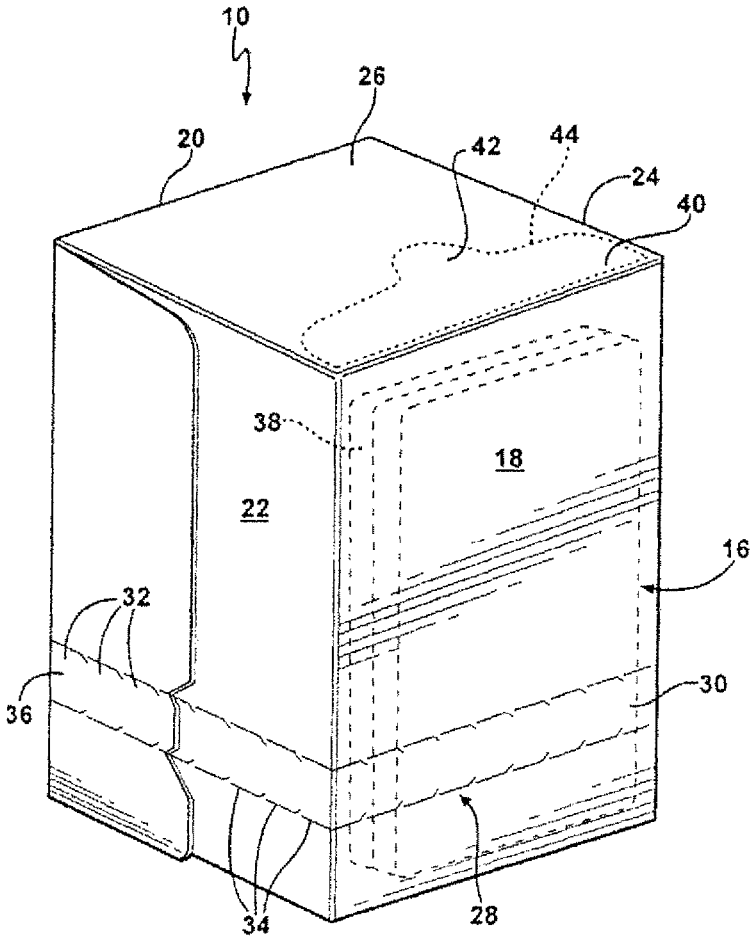
FIG. 1 illustrates a perspective view of the inventive container.
Figure 2:
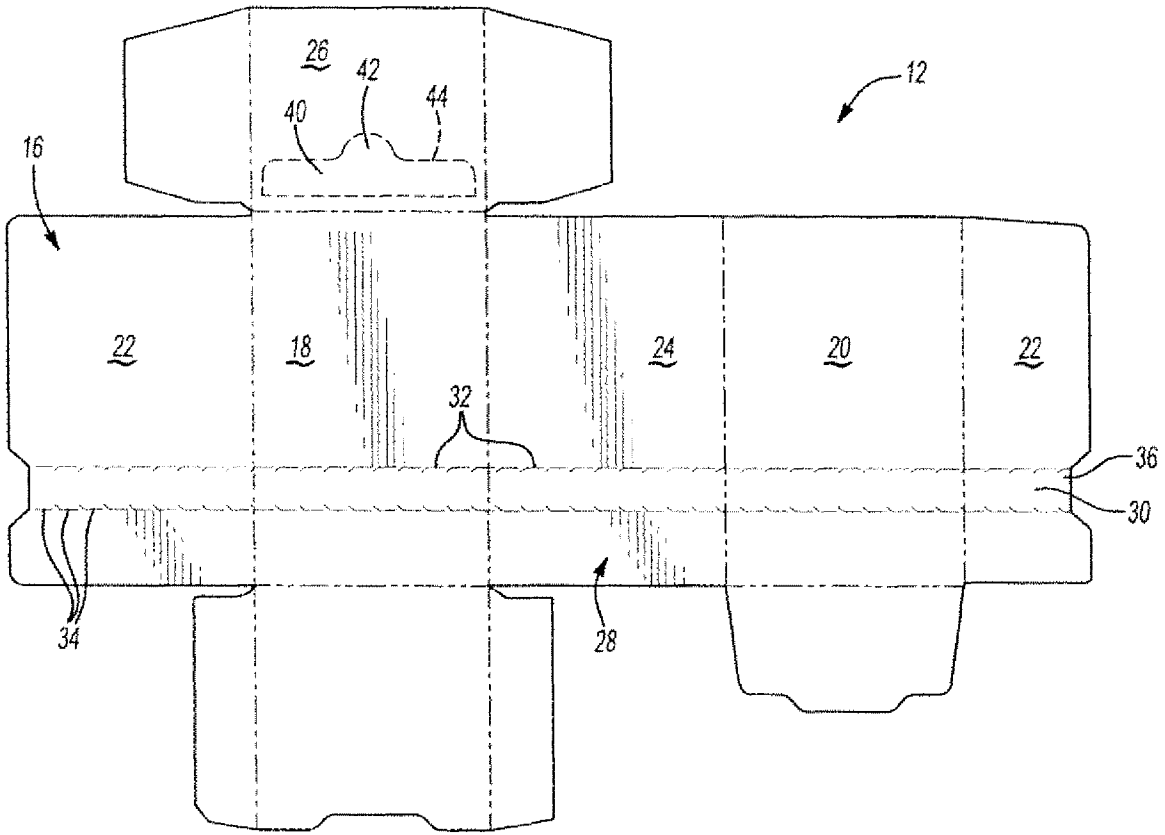
FIG. 2 is a top plan view of a blank of the container shown in FIG. 1 with plurality of fold lines separating the blank to panels foldable about the fold lines.
Figure 3:
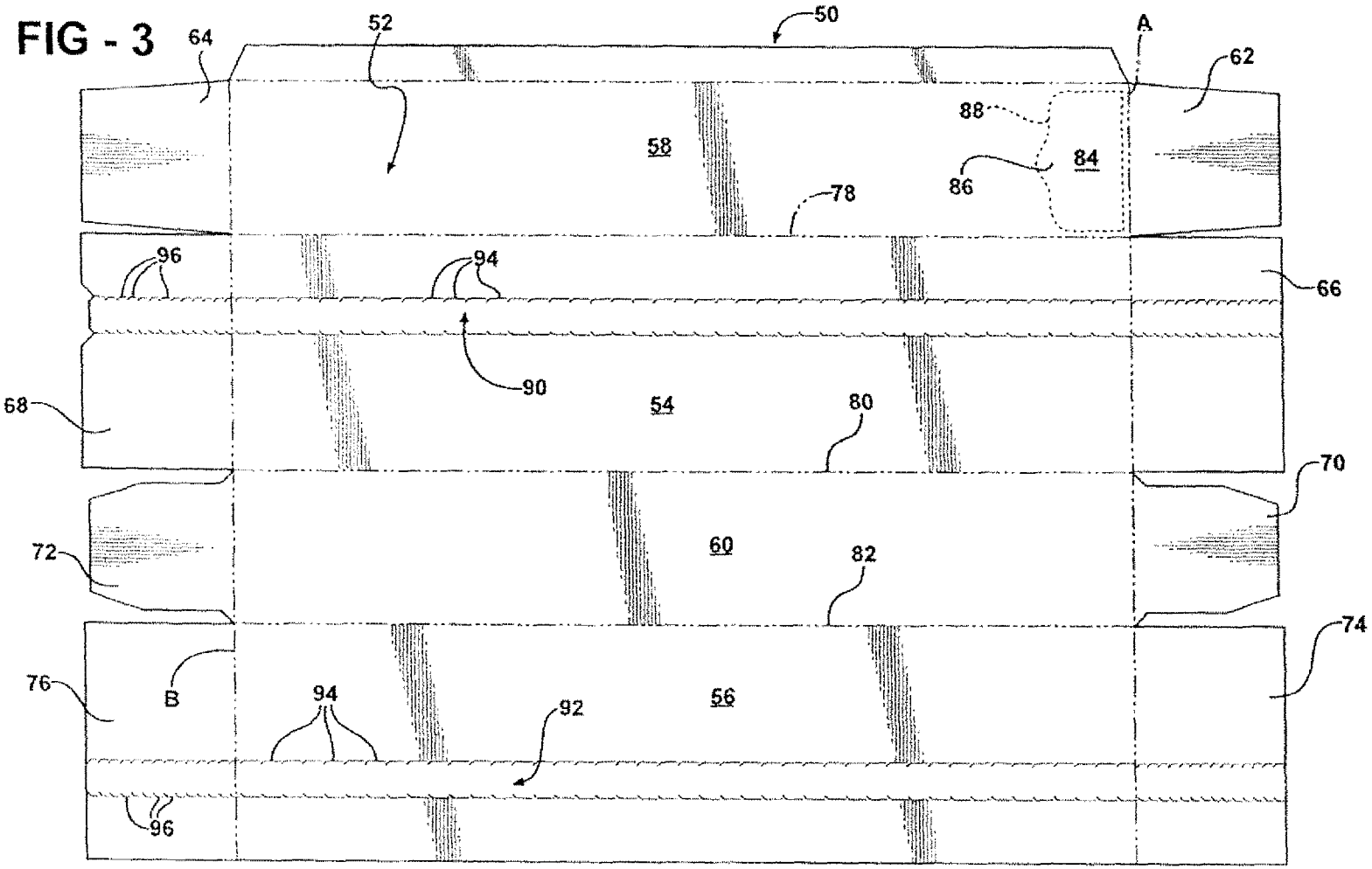
FIG. 3 is a top plan view of a blank of an alternative embodiment of the container with a plurality of fold lines separating the blank into panels foldable about the fold lines.
Figure 4:
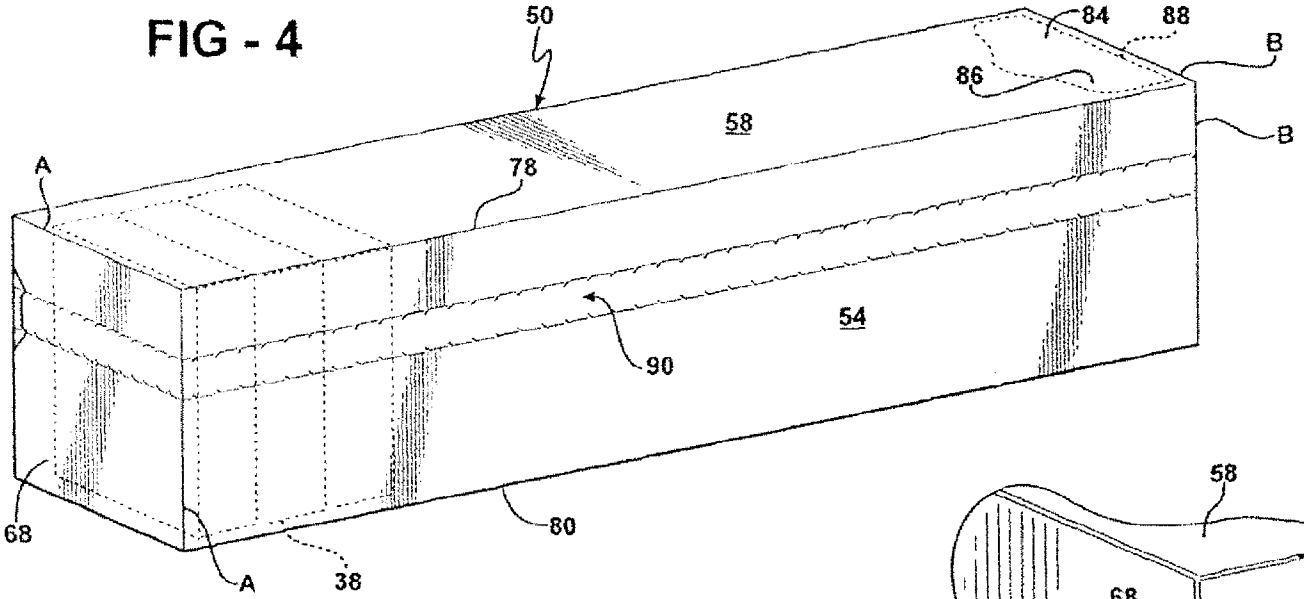
FIG. 4 is a perspective view of the alternative embodiment of the inventive container.

Referring to the FIGS. 1 and 2, wherein like numerals indicate like or corresponding parts throughout the several views, a container is generally shown at 10. The container 10 is farmed from a blank of material, such as for example corrugated material, plastic or paperboard, generally shown at 12 in FIG. 2. The blank 12 includes an inner surface (not shown) and an outer surface, generally indicated at 16 and adapted for receiving printed material. The blank 12 is divided into four parts, such as, for example, a front panel 18, a back panel 20, and side panels 22, 24, with one of the side panels 22 being formed from two halves connected to one another by glue or other mechanical means known to those skilled in the art. In the illustrated embodiment, the front panel 18, the back panel 20, and the side panels 22 and 24 have equal heights and widths but other heights and widths would be obvious to those of ordinary skill in the art.

The container 10 includes a tear line or tear tape 30 defined by spaced or opposing perforations 32 and 34 extending about periphery of the container 10. The tear tape 30 extends into a gripper 36. The gripper 36 is used by a consumer to tear the tear tape 30 along the spaced perforations 32 and 34 around the periphery of the container 10 to expose the container 10 to an open top as the bottom part, generally indicated at 28, remains as the base of the container 10. It should be understood that the use of top and bottom are for descriptive purposes only and the terms could be reversed without effecting the scope of the invention. Also, the tear tape 30 is shown as being parallel to the top or bottom, but it should be understood that the tear tape could be angled, shaped, curved etc. All items, such as bars, shown in phantom at 38, contained in the container 10 are exposed to and are accessible to the consumer. A top panel 26 integral with and foldable relative to the front panel 18 includes a section 40 extending to a thumb insert or puller 42 defined by a nonlinear perforation 44. It should be understood that linear perforations could also be used and the section 40 could have any number of different shapes. Only a smaller part of the bars 38 is exposed to the consumer as the section 40 is removed from the top panel 26, which limits the number of the bars 38 removable by the consumer at one time. It should be understood that the container 10 could contain other products and could be of various sizes such as for example a larger container could be used to contain boxes of food, such as for example cereal boxes, or cartons containing light bulbs, pet supplies, etc.

Referring to FIGS. 3 through 6, an alternative embodiment of the container is generally shown at 50. A blank of the container 50 is generally indicated at 52 in FIG. 3. The blank 52 presents a plurality of panels, in particular, a front panel 54, a back panel 56, and side panels 58, 60 spaced by the front and back panels 54 and 56. Each of the aforementioned panels 54 through 60 extends to top and bottom flaps 62 through 76, respectively. Each panel 54 through 60 extends along common top and bottom axis A and B. The common top and bottom axis A and B define corners between the front panel 54, the back panel 56, and the side panels 58, 60, and the respective top and bottom flaps 62 through 76 as the blank 52 is erected to the container 50.

The side panel 58 is foldable relative to the front panel 54 about a first fold line 78, the front panel 54 is foldable relative the side panel 60 about a second fold line 80. Similarly, the back panel 56 is foldable relative the side panel 60 about a third foldable line 82. The side panel 58 includes a tear section 84 extending to a thumb insert or puller 86 defined by a non-linear perforation 88. Only smaller part of the bars 38 is exposed to the consumer (shown in phantom) as the tear section 84 is pealed away from the container 50.

Figure 5:
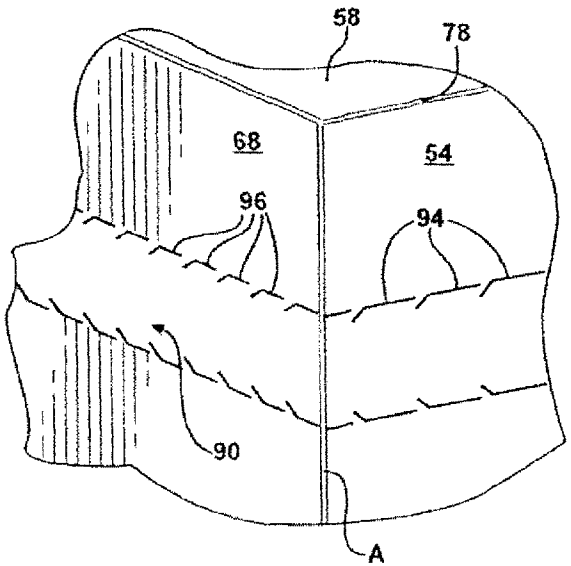
FIG. 5 is a perspective fragmental view of the container shown in FIG. 4 and illustrating a tear line or strip having a multitude of perforations or slits spaced at different distances from one another.
Figure 6:
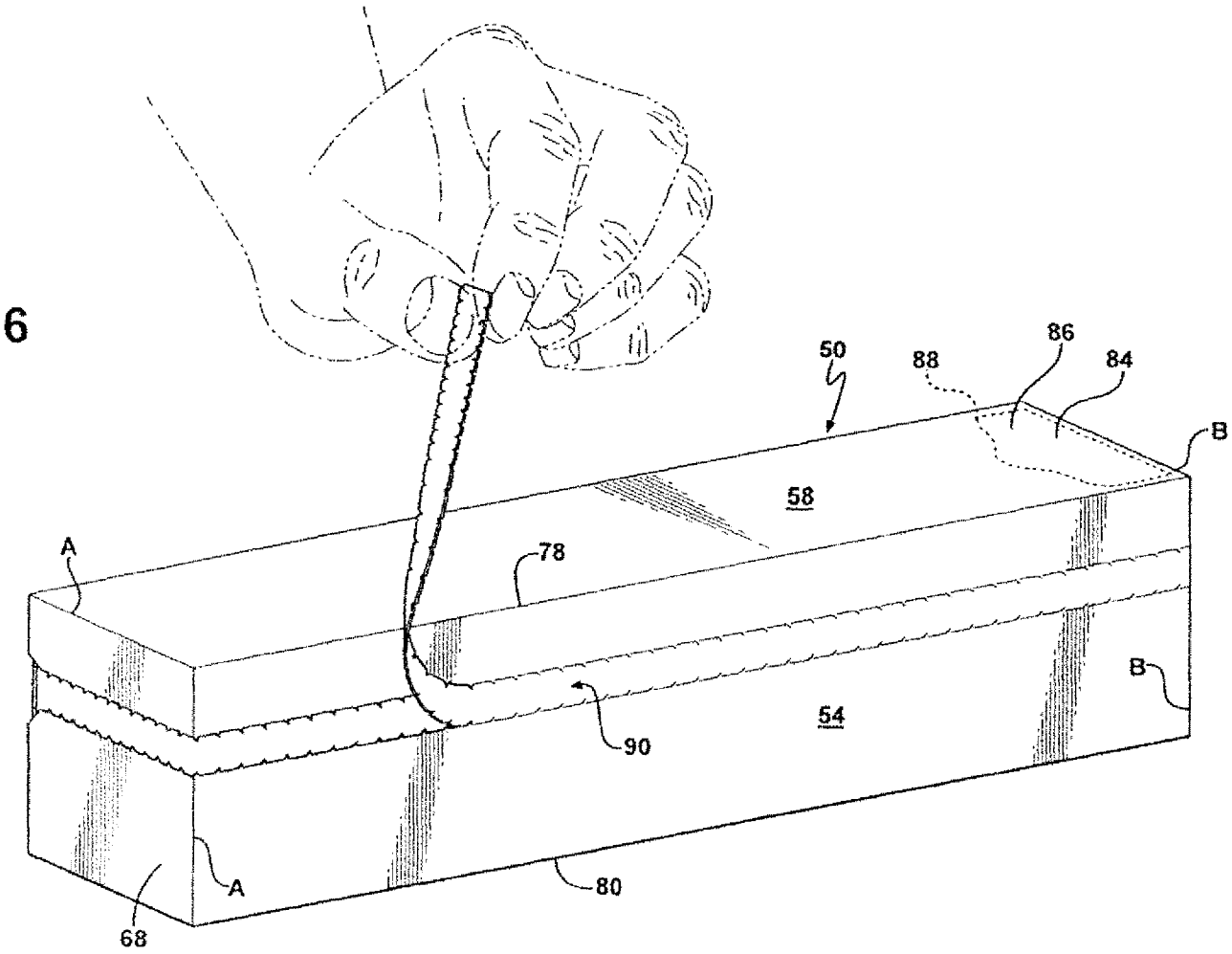
FIG. 6 a perspective view of the alternative embodiment of the inventive container shown in FIG. 4 illustrating the tear line being peeled from the container without damaging or deforming the corners of the container.

The blank 52 includes first and second tear lines, generally indicated at 90 and 92, to facilitate opening the container 50 to provide access to the interior. The first tear line 90 is defined in the front panel 54 and respective flaps 66 and 68. Similarly, the second first tear line 92 is defined in the back panel 56 and respective flaps 74 and 76 and extends longitudinally relative to the third fold line 82. Each of the first and second tear lines 90 and 92 includes a multitude of slits or perforations 94 and 96. As best shown in FIG. 5, the slits 94, which are located in selected portions of the first and second tear lines 90 and 92, in particular where the tear lines 90 and 92 extend through the front panel 54 and the back panel 56, respectively, are substantially longer than the slits 96 in the tear lines 90 and 92 extending through the flaps 66, 68, 74, and 76 to facilitate cleanly tearing the first and second tear lines 90 and 92 across the corners without damaging or deforming the corners of the carton 50. The inventive configuration of the slits 94 and 96 may also be applicable in the design of the slits 32 and 34 of the tear line 30 of the container 10.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A container erected from a blank of a material for holding a product, said container comprising:

a plurality of panels extending between a common top fold line and a common bottom fold line and foldable relative to one another along multiple fold lines thereby forming said container of a tubular configuration;

a plurality of flaps integral with and foldable relative each of said panels along said common top and bottom fold lines to form a bottom end and a top end of said container;

at least one peripheral tear line extending around said container and along at least one of said plurality of panels and at least one of said plurality of flaps for exposing said container to an open top thereby exposing all of the product; and said at least one peripheral tear line including a first multitude of slits disposed along said at least one of said plurality of flaps with each of said slits in said first multitude of slits having a straight portion along the tear line and an inwardly angled portion and a second multitude of slits disposed along said at least one of said plurality of panels with each of said slits in said second multitude of slits having a straight portion along the tear line and an inwardly angled portion, the straight portions of the slits in said first multitude of slits being different in length from the straight portions of the slits in said second multitude of slits.

2. The container of claim 1, wherein said first length is shorter than said second length.

3. The container of claim 1, further including a tear section defined within said at least one of said panels by a perforation line with said tear section being separable from said at least one of said panels for partially exposing the product contained in said container.

4. The container of claim 3, wherein said at least one of said plurality of panels has a width and said tear section has a width generally equal to said panel width.

5. The container of claim 3, wherein said at least one of said plurality of panels has a height, said tear section has a height that is less than said panel height.

6. The container of claim 5, wherein said tear section height is less than ½ said panel height.

7. The container of claim 5, wherein said tear section height is less than ⅓ said panel height.

8. The container of claim 3, wherein said at least one of said plurality of panels has a width and height, said tear section has a width generally equal to said panel width and a height that is less than said panel height.

9. The container of claim 1, wherein said at least one of said plurality of flaps is disposed adjacent said at least one of said plurality of panels.

* * * * *